US006075003A

United States Patent [19]

Haq et al.

[11] Patent Number: 6,075,003

[45] **Date of Patent: *Jun. 13, 2000**

[54] FABRIC LAUNDRY TREATMENT COMPOSITION

[75] Inventors: Ziya Haq, Bebington; Stuart Peter Holt, Swindon; Adelle Louise Killey, Bebington, all of United Kingdom; Carlos Petri, Sao Paulo, Brazil; Christopher Whaley, Bebington, United Kingdom

[73] Assignee: Lever Brothers Company, division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/042,059

[22] Filed: Mar. 13, 1998

[30] Foreign Application Priority Data

Mar. 14, 1997 [BR] Brazil ..... 9701287

[51] Int. Cl.[7] ..... C11D 3/37; C11D 1/62

[52] U.S. Cl. ..... 510/516; 510/504; 510/475

[58] Field of Search ..... 510/504, 515, 510/521, 522, 516, 475

[56] References Cited

U.S. PATENT DOCUMENTS

| | | | |
|---|---|---|---|
| 3,438,925 | 4/1969 | Raynolds et al. | 260/29.4 |
| 3,468,697 | 9/1969 | Hunter | 117/66 |
| 4,054,592 | 10/1977 | Dear et al. | 560/25 |
| 4,137,180 | 1/1979 | Naik et al. | 252/8.8 |
| 4,929,471 | 5/1990 | Groelinger | 427/173 |
| 5,395,555 | 3/1995 | Colurciello et al. . | |

FOREIGN PATENT DOCUMENTS

| | | |
|---|---|---|
| 059944 A1 | 9/1982 | European Pat. Off. . |
| 234311 | 9/1987 | European Pat. Off. . |
| 372848 A2 | 6/1990 | European Pat. Off. . |
| 398133 | 11/1990 | European Pat. Off. . |
| 309052 | 11/1992 | European Pat. Off. . |
| 506312 | 9/1993 | European Pat. Off. . |
| 648890 B1 | 12/1996 | European Pat. Off. . |
| 60-173166 | 9/1985 | Japan . |
| 62-78277 | 4/1987 | Japan . |
| 5-51876 | 3/1993 | Japan . |
| 1120708 | of 0000 | United Kingdom . |
| 1171952 | of 0000 | United Kingdom . |

*Primary Examiner*—Yogendra Gupta
*Assistant Examiner*—John R. Hardee

[57] ABSTRACT

A fabric laundry treatment composition comprising:

a) a fluorocarbon polymer or a fluorocarbon copolymer or mixtures thereof;

b) a deposition aid comprising a cationic softening compound or a polymeric delivery aid or mixtures thereof;

with the proviso that when the deposition aid is solely a cationic fabric softening compounds the ratio of b):a) is greater than or equal to 2:3.

9 Claims, No Drawings

FABRIC LAUNDRY TREATMENT COMPOSITION

TECHNICAL FIELD

The present invention relates to fabric laundry treatment compositions. In particular the invention relates to fabric laundry treatment compositions that have excellent soil repellency properties.

BACKGROUND AND PRIOR ART

Soil release properties are generally imparted to fabrics by the use of separate soil-release agents, usually a high molecular weight polymer, in a detergent composition or separate treatment. For example in EP 0 398 133 A (Procter & Gamble) there is disclosed a cationic polymeric soil release agent for use in a fabric conditioning composition.

EP-A-O,234,311 describes the use of insoluble polyfunctional quaternary ammonium compounds as soil collectors, to regenerate soil-laden detergent solutions.

EP-A-O,309,052 describes the use of quaternary ammonium salts containing at least one ester linkage as softeners in shelf-stable and biodegradable fabric softening compositions. The compositions also include a linear alkoxylated alcohol.

EP 0,506,312 (Unilever) discloses the use as a soil release agent, of a quaternary ammonium material comprising a compound having two $C_{12}$-$_{18}$ alkyl or alkenyl groups connected via an ester link to a hydrocarbon chain which is connected to the quaternary nitrogen atom.

Composition can be formed that exhibits excellent soil release properties resulting from improved delivery of a fluorinated or partially fluorinated soil release agent.

Additionally the formulations of the present invention can exhibit enhanced softening, perfume delivery, and give good antistatic properties to fabric.

DEFINITION OF THE INVENTION

Thus according to one aspect of the invention there is provided a fabric laundry treatment composition comprising:

a) a fluorocarbon polymer or a fluorocarbon copolymer or mixtures thereof;

b) a deposition aid comprising a cationic softening compound or a polymeric delivery aid or mixtures thereof;

with the proviso that when the deposition aid is solely a cationic fabric softening compounds the ratio of b):a) is greater than or equal to 2:3.

A further aspect of the invention provides a method of treating fabrics to provide them with soil repelling properties comprising the steps of:

i) adding the formulation described above to water;

ii) washing, or preferably rinsing, laundry in the resulting liquor;

iii) drying the laundry;

iv) ironing the laundry at a temperature above 150° C.

DETAILED DESCRIPTION OF THE INVENTION

The present invention relates to fabric treatment compositions comprising a deposition aid and fluoro-polymer and/or co-polymer, in which the deposition aid is selected from cationic fabric softening compounds or polymeric delivery aids or a combination of these two, with the proviso that when the deposition aid is solely a cationic fabric softening compound the ratio of cationic fabric softening compound to fluoro-polymer and/or co-polymer is greater than or equal to 2:3 preferably greater than or equal to 3:2, most preferably greater than 3:1.

Particularly preferred fluorocarbon polymers are homo- and co-polymers of acrylates and methacrylates of fluorocarbon alcohols, particularly those based on 1H,1H-perfluoroalkanol esters and 1H,1H,2H,2H-perfluoroalkanol esters.

It is preferred if the fluorocarbon polymer/co-polymer is a homo- and co-polymers of the monomer:

$$CH_2{=}C(R)\ CO.O(CH_2)_nRf$$

where R is H or $CH_3$, n is 1 or 2, and Rf is a perfluoroalkyl residue, preferably $C_2$–$C_{18}$, more preferably $C_6$–$C_{12}$.

Preferably the fluorocarbon polymer is a perfluoroalkyl acrylic copolymer, further preferably a perfluoroalkyl methacrylic copolymer.

Preferably the fluorocarbon copolymer is a fluorinated substituted urethane. It is also preferred if the flurocarbon polymer is a fluorinated acrylic copolymer.

It is further preferred if the fluorocarbon polymer is present as a cationic emulsion. An example of a particularly preferred polymer present as a cationic emulsion is Zonyl 6991 (trademark ex Du Pont)an acrylate polymer, having as a monomer unit the above formula, in which R=H, and n=2.

It is advantageous in some instances if the cationic emulsion of fluoropolymer further comprises a short chain carboxylic acid, It is also preferable if the cationic emulsion of fluoropolymer further comprises a paraffin wax.

As described above it is preferable that if after treatment of laundry with the fabric conditioner of the invention the laundry is heat treated to cure the fluorocarbon polymer. This can be done either by tumble drying the laundry or by ironing. If ironing is used it is preferred if the iron is hot (greater than 150° C.

The Deposition Aid

Suitable deposition aids include cationic fabric softening compounds and polymeric delivery aids that are able to attach themselves to the fluorocarbon soil release agent and cause enhanced delivery to the fabric.

Suitable cationic fabric softening compounds are water insoluble quaternary ammonium material comprising a polar head group and two alkyl or alkenyl chains each having an average chain length equal to or greater than $C_{12}$. When these materials are used as delivery aids they are used at a ratio to the fluorocarbon material of greater than 2:3, preferably greater than 3:2.

Preferable fabric softening compounds of the invention have two long chain alkyl or alkenyl chains with an average chain length equal to or greater than $C_{14}$. More preferably each chain has an average chain length equal or greater than $C_{16}$. Most preferably at least 50% of each long chain alkyl or alkenyl group has a chain length of $C_{18}$.

In one embodiment of the invention a preferred cationic softener is distearyl dimethyl ammonium chloride.

It is preferred if the long chain alkyl or alkenyl groups of the fabric softening compound are predominantly linear.

Substantially insoluble fabric softening compounds in the context of this invention are defined as fabric softening compounds having a solubility less than $1\times10^{-3}$ wt% in demineralised water at 20° C. Preferably the fabric softening compounds have a solubility less than $1\times10^{-4}$ Most preferably the fabric softening compounds have a solubility at 20° C. in demineralised water from $1\times10^{-8}$ to $1\times10^{-6}$.

In one preferred embodiment the fabric softening compound is a quaternary ammonium material having two $C_{12-22}$ alkyl or alkenyl groups connected to the quaternary ammonium head group via at least one ester link. It is more preferred if the quaternary ammonium material has two ester links present. The especially preferred ester-linked quaternary ammonium material for use in the invention can be represented by the formula:

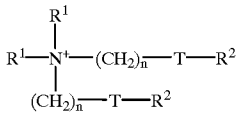

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups;

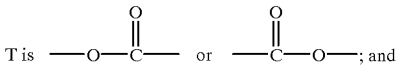

n is an integer from 0-5.

Di(tallowyloxyethyl)dimethyl ammonium chloride, available from Hoechst, is especially preferred.

A second preferred type of quaternary ammonium material can be represented by the formula:

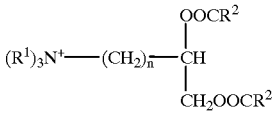

wherein $R^1$, n and $R^2$ are as defined above.

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4 137 180 (Lever Brothers). Preferably these materials comprise small amounts of the corresponding monoester as described in U.S. Pat. No. 4 137 180 for example 1-hardened tallowoyloxy-2-hydroxy-3-trimethylammonium propane chloride.

Prefered polymeric delivery aids for use with the invention include the cellulose ether derivatives described in GB-A-2266100 and other polymers cited therein and mentioned as being in earlier documents.

A second form of preferred polymeric delivery aids are cationic polymers, for example cationic starch derivatives, cationic cellulose derivatives, guar gums (including those sold under the Trade name Jaguar by Rhone-Poulenc), quaternised protein derivatives, homo- and co-polymers of dimethyldiallylammonium chloride, and homo- and co-polymers of quaternised dimethylaminoethyl methacrylate.

Other preferred polymeric delivery aids are silicone derivatives containing amine groups or cationic groups or a combination of the two.

Especially preferred formulations contain as delivery aid both cationic fabric softening compound and a polymer.

Composition pH

The compositions of the invention preferably have a pH of more than 1.5 and less than 5.

Other Ingredients

The composition can also contain fatty acids, for example $C_8$–$C_{24}$ alkyl or alkenyl monocarboxylic acids, or polymeric carboxylic acids. Preferably saturated fatty acids are used, in particular, hardened tallow $C_{16}$–$C_{18}$ fatty acids.

The level of fatty acid material is preferably more than 0.01 by weight, more preferably more than 0.02% by weight. Especially preferred are concentrates comprising from 0.05 to 10% by weight of fatty acid, more preferably 0.1% to 10% by weight. The weight ratio of fabric softening compound to fatty acid material is preferably from 50:1 to 1:5 preferably 40:1 to 4:1.

Compositions according to the present invention may contain detergency builders and/or anionic surfactants as desired. However it is especially preferred that the composition is substantially free of builders. It is also preferred that the composition be substantially free of anionic surfactant.

The composition can also contain one or more optional ingredients, selected from non-aqueous solvents, pH buffering agents, perfumes, perfume carriers, fluorescers, colorants, hydrotropes, antifoaming agents, antiredeposition agents, polymeric or other thickeners, enzymes, optical brightening agents, opacifiers, anti-shrinking agents, anti-wrinkle agents, anti-spotting agents, germicides, fungicides, anti-oxidants, anti-corrosion agents, drape imparting agents, antistatic agents and ironing aids.

Product Form

The product may be in any product form. Particularly preferred forms are liquid and solid compositions. Solid composition in this context includes compositions in the form of a tablet, a gel, a paste and preferably granules or a powder.

The invention will now be illustrated by the following non-limiting examples. In the examples all percentages are expressed by weight.

The following examples were prepared by mixing hot cationic softening compound with water followed by addition of Zonyl 6991 and adding conventional ingredients such as perfume.

| | wt % | |
|---|---|---|
| | Example 1 | Example 2 |
| DHTDMAC[1] | 4.0 | 3.5 |
| Zonyl 6991[2] | 3.0 | 4.0 |
| Formaldehyde | 0.08 | 0.08 |

-continued

| | wt % | |
|---|---|---|
| | Example 1 | Example 2 |
| Perfume | 0.25 | 0.25 |
| Water and minors[a] | To 100% | |

[1]Di (hardened tallow) dimethyl ammonium chloride
[2]25% active fluoropolymer (ex Du Pont). wt % values refer to the material as received by Du Pont.
[a]minors associated with the raw materials present in all components of the examples.

| | wt % | |
|---|---|---|
| | Example 3 | Example 4 |
| HT TMAPC[3] | 2.0 | — |
| DEEDMAC[4] | | 2.0 |
| Zonyl 6991[2] | 5.28 | 5.28 |
| Water and minors[a] | to 100% | to 100% |

The above Examples were used to treat laundry during the domestic rinsing of laundry. Laundry thus treated was then dried and ironed with a hot iron (temperature greater than 150° C.). Laundry thus treated was both soft and exhibited good soil repellency.

| | wt % | | | |
|---|---|---|---|---|
| | A | B | C | D |
| HT TMAPC[3] | | 2.0 | | |
| DEEDMAC[4] | | | | 2 |
| Zonyl 6991[2] | | | | 5.28 |
| Water and minors[a] | | | to 100% | |

HT TMAPC[3] = 1,2 bis [hardened tallowoyloxy]-3-trimethylammonium propane chloride
DEEDMAC[4] = Di [2-(hardened tallowoyloxyl)ethyl]dimethylammonium chloride.
Wt % values for all softeners refer to the actual active concentrations in the formulated products.

Soil Repellancy (1)

The soil repellancy of examples 3,4,A,B,C and D were compared in the following test.

Water containing isopropanol (70:30) was used to represent aqueous-based soils, and olive oil containing 0.12% oil soluble dye was used to represent oily soils.

40 g of pre-washed fabric squares (8 cm×8 cm, cotton sheeting and cotton interlock) were treated with softener/fluoropolymer according to each of the above rinse conditioner Examples. This was done in tergotometer pots at ambient temperature, 70 rpm, liquor:cloth ratio 25:1, for 5 mins. Dosages used were 0.1 g/l softener and/or 0.066 g/l fluoropolymer. After line drying, the fabric squares were ironed using a plate temperature of 210° C.

The soil repellancy of the treated fabrics were calculated by accurately weighing the amount of the soil removable from the fabrics following saturation with soil (water/IPA or olive oil/dye) and removal of non-absorbed soil by paper tissue pressed onto the fabric by a 1 kg weight for 5 seconds.

RESULTS

| | Soil Repellancy (%) | | | |
|---|---|---|---|---|
| | Water/IPA | | Olive Oil | |
| Formulation | sheeting | interlock | sheeting | interlock |
| 3 | 60.5 | 75.9 | 59.8 | 90.5 |
| 4 | 49.6 | 61.5 | 69.3 | 90.5 |
| A | 12.3 | 7.9 | 50.4 | 33.8 |
| B | 36.4 | 16.7 | 50.4 | 40.9 |
| C | 14.5 | 10.1 | 31.4 | 7.8 |
| D | 32.0 | 17.6 | 50.4 | 38.5 |

It is clear from these results that the formulations of the invention have clearly superior repellancy to both water- and oil-based soils.

Softening Performance

Formulations 3 and B were used to treat cotton terry towelling under the same conditions as used for the above soil repellancy test. After drying, the softness of the treated towelling was assessed by an expert panel. The scores below represent softness vs. standards; with standard 2 representing extremely soft fabric and standard 8 representing extremely harsh fabric.

RESULTS

| Formulation | Softness score (vs. standards) |
|---|---|
| 3 | 3 |
| B | 3.5 |

Both formulations gave good softening and the difference between the two was not found to be significant. This result shows that formulations of the present invention have good softening performance as well as superior soil repellancy, surprisingly, the superior soil repellancy characteristics have not been counteractive towards the softening characteristics of the formulations of the present invention.

The following examples were prepared by mixing hot cationic softening compound with water followed by addition of active fluoropolymer. In some examples, fatty acid material was added and in others conventional ingredients such as perfume.

| | wt % | | | | | | | |
|---|---|---|---|---|---|---|---|---|
| | 5* | 6* | 7* | 8* | 9 | 10* | 11* | 12* |
| HT TMAPC[3] | 4.3 | 4.5 | 10.0 | 11.5 | 5 | 7.55 | 8.7 | 12.7 |
| ZONYL 6991[2] | 11.2 | 6.0 | 26.3 | 15.1 | | 43.2 | 34.8 | 5.2 |
| ZONYL 8300[5] | | | | | 26 | | | |
| Perfume | 0.28 | 0.3 | 0.66 | 0.76 | | 0.9 | 0.9 | 0.9 |
| Water and minors[a] | | | | up to 100% | | | | |

[5]18% active fluoropolymer (ex Du Pont). Wt % values refer to the material as received from Du Pont.
*Examples 5–8 and 10–12 incorporate quaternary ammonium material which is partially substituted by a hardened tallow fatty acid, at a ratio quaternary ammonium: fatty acid, 6:1.

| | wt % | | | | | | |
|---|---|---|---|---|---|---|---|
| | 13 | 14 | 15 | 16 | 17 | 18 | E |
| HT TMAPC[3] | | | 5 | 5 | 5 | 5 | 5 |
| DEEDMAC[4] | 9.0 | 13.4 | | | | | |
| ZONYL 6991[2] | 36.0 | 5.2 | | | | | |
| GERMUL F321[6] | | | 20 | | | | |
| GERMUL F503[7] | | | | 15 | | | |
| FC - 3546[8] | | | | | 15 | | |
| FC - 248[9] | | | | | | 15 | |
| Perfume | 0.9 | 0.9 | | | | | |
| Water and minors[a] | | | up to 100% | | | | |

[6]Fluorinated acrylic co-polymer, supplied by Elf Atochem. wt % value refers to the material as sold by Elf Atochem, the fluoropolymer content being 20%.
[7]Fluorinated acrylic co-polymer, supplied by Elf Atochem. Wt % value refers to the material as sold by Elf Atochem, the fluoropolymer content being 20%.
[8]Cationic fluoropolymer emulsion mixture supplied by 3M, comprising fluorochemical adipate, urethane and acrylate. Wt % value refers to the material as sold by 3M, the fluoropolymer content being 29.5%.
[9]Nonionic fluoropolymer resin, supplied by 3M. Wt % value refers to the material as sold by 3M, the fluoropolymer content being ca. 30%.

Soil Repellance (2)

The soil repellancy of examples E and 9 were compared in the following test (a slight modification of the one previously described).

Water containing isopropanol (70:30) was used to represent aqueous-based soils, and olive oil was used to represent oily soils.

15 g of pre-washed fabric squares (8 cm×8 cm, cotton sheeting) were treated with softener/fluoropolymer according to each of the above rinse conditioner Examples. This was done in tergotometer pots at ambient temperature, 70 rpm, liquor:cloth ratio 67:1, for 5 mins. Dosages used gave 0.0375 g/l softener plus 0.035 g/l fluoropolymer (Zonyl 8300). After treatment the fabrics were left to line dry, ironed at 210° C. and then soil repellancy was determined as before.

RESULTS

| | Soil Repellancy (%) | |
|---|---|---|
| Formulation | Water/IPA | Olive Oil |
| E | 45.4 | 57.2 |
| 9 | 81.6 | 84.6 |

It is again clear from these results that the formulations of the invention have clearly superior repellancy to both water-based and oil-based soils.

Soil Repellancy (3)

The soil repellancy of treatments E and 15–18 were compared in a similar test to the above, but with dosages such that softener was present at 0.5 g per 100 g fabric. Superior stain repellancy is again evident.

RESULTS

| | Soil Repellancy (%) | |
|---|---|---|
| Formulation | Water/IPA | Olive Oil |
| E | 37.1 | 53.5 |
| 15 | 83.8 | 97.9 |
| 16 | 100 | 100 |
| 17 | 100 | 100 |
| 18 | 53.3 | 68.3 |

Crease Angle Recovery (CRA) Example

Fabric pieces (5×5 cm×2 cm) were treated as for the soil repellany tests. Dosages used: 0.25 g softener per 100 g fabric and 0.132 g fluoropolymer (when present) per 100 g fabric. After ironing, the fabrics were left to equilibrate for 24 hours under conditions of controlled temperature and humidity (20° C., 65% RH), prior to measurement of weft crease angle recovery according to a method based on BS 3086 (1972).

Treatments

A water control (demin. water)
B softener control (HT TMAPC[3])
19 HT TMAPC[3] plus Zonyl 8300[5]
20 HT TMAPC[3] plus Zonyl 8300[5] (two applications)
(Softener: Fluoropolymer ratio of 19/20 is 5.7:3).

RESULTS

| Example | CRA (s.d.) - degrees |
|---|---|
| A | 73.6 (2.0) |
| B | 70.4 (3.1) |
| 19 | 82.3 (1.2) |
| 20 | 84.2 (4.7) |

The improved crease recovery of the fabrics treated with the formulations according to the invention is very clear.

Further Examples:

| | Wt % | |
|---|---|---|
| | F | 21 |
| HITMAPC[3] | | 5 |
| Zonyl 7910[10] | 20 | 20 |
| Water and minors[a] | | up to 100% |

[10]33% active fluoropolymer content, of a fluorinated substituted urethane (ex Du Pont).

Further perfluoroalkyl methacrylic copolymers and fluorinated substituted urethanes (e.g. Zonyl 8110, ex Du Pont) are available for use within the scope of this invention.

Soil Repellancy (4)

The soil repellancy of treatments F and 21 were compared as before, using the following conditions.

10.5 g of pre-washed fabric squares (8 cm×8 cm, cotton sheeting) were treated with softener/fluoropolymer according to each of the above rinse conditioner Examples. This was done in tergotometer pots at ambient temperature, 60 rpm, liquor:cloth ratio 24:1, for 5 mins. Dosages used gave 0.25g softener per 100 g fabric plus 0.33 g fluoropolymer (Zonyl 7910), when present. After treatment the fabrics were left to line dry, half were ironed at 210° C., and then soil repellancy was determined as before.

RESULTS

| Formulation | Soil Repellancy (%) Water/IPA Ironed | Water/IPA Not Ironed | Olive Oil Ironed | Olive Oil Not Ironed |
|---|---|---|---|---|
| F | 33.1 | 39.1 | 42.9 | 51.4 |
| 21 | 47.3 | 53.3 | 78.9 | 83.1 |

The benefit for the formulation of the invention is clear; both with and without post-treatment ironing.

Further examples according to the invention were prepared by adding perfume and commercial fluoropolymer dispersion to pre-formed softener dispersions at ambient temperature with gentle stirring control formulations were prepared by adding perfume and demineralised water to the base softener disperion to give the same softener concentration as the corresponding fluorocarbon formulation.

| | Wt % Ex22 | Ex23 | G | H | I |
|---|---|---|---|---|---|
| DHTMAC[1] | 4.0 | 4.9 | 4.0 | 4.9 | 4.3 |
| Zonyl8110[12] | 20.4 | 2.5 | | | |
| Perfume | 0.15 | 0.15 | 0.15 | 0.15 | 0.15 |
| Water and Minors[a] | | | up to 100% | | |

[12]fluorinated substituted urethane contains 19.5% fluropolymer as sold by DuPont.

Further examples were prepared by mixing the softener, fluorocarbon and water at 70° C. for ten minutes, with addition of perfume after cooling.

| | Wt % 24 | 25 | K | L |
|---|---|---|---|---|
| DHTDMAC[1] | 4.0 | 4.9 | 4.0 | 4.9 |
| Zonyl 8110[12] | 20.4 | 2.5 | | |
| Perfume | 0.15 | 0.15 | 0.15 | 0.15 |
| Water and minors | | | up to 100% | |

Viscosity Data

The fluorocarbon polymers are able to 'flatten out' the viscosity vs. shear rate profiles for the above dispersions —i.e. make them less shear thinning and hence somewhat more Newtonian in behaviour. Sometimes this can result in a lower viscosity for the sample, particularly at low shear (eg. 20 s-1), which can equate to improved ease of pouring. The data presented below illustrate these effects. The drop in viscosity on going from 20 s-1 to 106 s-1 can be taken as an indication of extent of shear thinning.

| Pair | Viscosity (mPa.s)* at 20 s-1 with f/c | at 20 s-1 control | drop on going from 20 s-1 to 106 s-1 with fluorocarbon | drop on going from 20 s-1 to 106 s-1 control |
|---|---|---|---|---|
| 22 and G | 27.9 | 652.1 | 11.5 | 460.6 |
| 23 and H | 293.3 | 2246 | 176.6 | 1805 |
| 24 and K | 39.7 | 1092 | 25.2 | 837.5 |
| 25 and L | 274 | 1692 | 164.1 | 1364 |

*Viscosities were measured on a Haake RV20 rotoviscometer using the NV cup and bob.
Values quoted are average readings over 2 mins.

We claim:

1. A fabric softening composition comprising:

a) a fluorocarbon polymer which is a homo- or co-polymer of the monomer:

$$CH_2{=}C(R)\ CO.O(CH_2)_nRf$$

in which R is H or $CH_3$, n is 1 or 2, and Rf is a perfluoroalkyl residue, or said fluorocarbon polymer is a fluorinated substituted urethane or a fluorinated acrylic co-polymer; and b) a deposition aid comprising a quartemary ammonium-cationic softening compound having two $C_{12-22}$ alkyl or alkenyl groups connected to the quaternary ammonium via at least one ester link;

with the proviso that the ratio of b):a) is greater than or equal to 2:3.

2. A fabric softening composition according to claim 1 in which the weight ratio of cationic fabric softening compound to fluorocarbon polymer is at least 3:1.

3. A fabric softening composition according to claim 1 in which the fluorocarbon polymer is a copolymer.

4. A fabric softening composition according to claim 1 in which the fluorocarbon polymer is present as a cationic emulsion.

5. A fabric softening composition according to claim 1 in which the fabric softening compound has a solubility of less than $1\times10^{31\ 3}$ Wt % in demineralised water at 22° C.

6. A method of treating fabrics to provide them with soil repelling properties comprising the steps of:

i) adding the formulation according to claim 1 to water;

ii) adding laundry to the resulting liquor;

iii) drying the laundry;

iv) ironing the laundry at a temperature above 150° C.

7. A method of improving the crease recovery of fabrics comprising:

a) providing a fabric softening composition comprising:

i) a fluorocarbon polymer which is a homo- or co-polymer of the monomer:

$$CH_2{=}C(R)\ CO.O(CH_2)_nRf$$

in which R is H or $CH_3$, n is 1 or 2, and Rf is a perfluoroalkyl residue, or said fluorocarbon polymer is a fluorinated substituted urethane or a fluorinated acrylic co-polymer; and ii) a deposition aid comprising a quaterary ammonium cationic softening compound having two $C_{12-22}$ alkyl or alkenyl groups connected to the quaternary ammonium via at least one ester link;

with the proviso that the ratio of ii):ii) is greater than or equal to 2:3; and b) treating fabric with the fabric softening composition.

8. A fabric softening composition according to claim 1, wherein the deposition aid further comprises cellulose ether derivatives.

9. A fabric softening composition according to claim 1 further comprising a perfume.

* * * * *